US008191741B2

(12) United States Patent
Yui

(10) Patent No.: US 8,191,741 B2
(45) Date of Patent: Jun. 5, 2012

(54) WATER DISPENSER FAUCET ACTUATORS

(76) Inventor: George Yui, Toronto (CA)

( * ) Notice: Subject to any disclaimer, the term of this patent is extended or adjusted under 35 U.S.C. 154(b) by 224 days.

(21) Appl. No.: 12/416,120

(22) Filed: Mar. 31, 2009

(65) Prior Publication Data

US 2010/0243683 A1 Sep. 30, 2010

(51) Int. Cl.
*B67D 3/00* (2006.01)

(52) U.S. Cl. ..... 222/505; 222/185.1; 222/153.14; 222/146.6; 251/100; 251/106

(58) Field of Classification Search ..... 222/146.6, 222/453.14, 185.1, 505, 153.14; 251/100, 251/102, 104, 106
See application file for complete search history.

(56) References Cited

U.S. PATENT DOCUMENTS

| | | | | |
|---|---|---|---|---|
| 5,762,317 | A * | 6/1998 | Frahm et al. | 251/95 |
| 6,824,018 | B1 * | 11/2004 | Eaddy et al. | 222/153.13 |
| 6,935,536 | B2 * | 8/2005 | Tardif | 222/153.14 |
| 6,962,319 | B2 * | 11/2005 | Zheng | 251/102 |
| D604,554 | S * | 11/2009 | Lippert et al. | D7/306 |
| 2006/0175355 | A1 * | 8/2006 | Glucksman et al. | 222/209 |

* cited by examiner

*Primary Examiner* — Jason Boeckmann

(57) ABSTRACT

Bottled water dispensers that include a cabinet having an exterior portion, which includes side walls, a top wall, and a bottom wall. The water dispensers include at least one water dispensing actuator, which includes a cap portion having an exterior top surface that is flush with the top wall of the bottled water dispenser. The cap portion also includes a button that is substantially parallel with a side wall of the dispenser. The exterior top surface of the cap portion must be pressed downwards, and the button must be pushed inwards, in order to release water from the dispenser.

4 Claims, 4 Drawing Sheets

WATER DISPENSER FAUCET ACTUATORS

FIELD OF THE INVENTION

The present invention relates generally to the field of bottled water dispensers and, more particularly, to faucet actuators for water dispensers.

BACKGROUND OF THE INVENTION

The demand for clean and healthy drinking water is increasing dramatically, which is being driven by the rapid growth in population and standards of living across the globe. This demand has translated into a continuing need for safe, clean, and easy to use water dispensers, including for both hot and cold water.

Many of the currently-available water dispensers suffer from at least several drawbacks. First, many of these water dispensers employ the use of lever faucets that are activated, i.e., cause water to be dispensed, by turning a faucet handle (lever) around an axis. This type of water dispensing actuator is not ergonomically preferred, insofar as the human hand and wrist must be contorted to turn the lever (which contortion is exacerbated by the fact that such dispensing actuators are often located in a relatively confined area of the water dispenser). In addition, many of the currently-available water dispensers, having conventional turn-style faucet actuators, include valve assemblies which are exposed to the air, thereby increasing the amount of air contact, potential human contact, and risk of contamination. Still further, many of the currently-available water dispensers do not include suitable child-proof mechanisms, which prevent a child from dispensing water, particularly hot water, without parent supervision.

As the following will demonstrate, many of the foregoing problems with currently-available water dispensers are addressed by the present invention.

SUMMARY OF THE INVENTION

According to certain aspects of the invention, bottled water dispensers are provided. The bottled water dispensers include a cabinet having an exterior portion, which includes side walls, a top wall, and a bottom wall. The water dispensers include at least one water dispensing actuator, which includes a cap portion having an exterior top surface that is flush with the top wall of the bottled water dispenser. The cap portion also includes a button that is substantially parallel with a side wall of the dispenser. The exterior top surface of the cap portion must be pressed downwards, and the button must be pushed inwards, in order to release water from the dispenser. The dispenser preferably comprises a stop, located within a recessed area of a side wall. The recessed area is adapted to receive a container into which water may be dispensed. The stop is preferably positioned near the top side of the recessed area, such that the stop will make contact with the container when it has been inserted into the recessed area a sufficient distance to receive dispensed water.

According to other aspects of the invention, actuating mechanisms are provided, which, upon being activated, cause water to be dispensed from the water dispensers described herein. More particularly, a first actuating mechanism is associated with the button of the cap portion mentioned above. A second actuating mechanism, a portion of which is also coupled with the cap portion, may not be activated unless the first actuating mechanism is activated—thereby providing a "child safety" feature for the water dispensers described herein. The second actuating mechanism is activated by pressing the exterior top surface of the cap portion downwards toward the interior portion of the water dispenser. The second actuating mechanism comprises an "h"-shaped push rod, which includes (i) a first portion that is operably coupled to the cap portion, (ii) a second portion that is received by a channel when the exterior top surface of the cap portion is pressed downwards, and (iii) a third portion that is operably coupled to a first end of a connecting rod.

A second end of the connecting rod is rotatably attached to a water tap release, such that upon pressing the exterior top surface of the cap portion downwards toward the interior of the water dispenser, a series of events occur to release water from the dispenser. Specifically, upon pressing the exterior top surface of the cap portion downwards, the first portion of the push rod is forced downward, causing the second portion to be inserted into the channel and the third portion to cause the connecting rod to also be forced downward. The downward movement of the connecting rod causes the water tap release to rotate upwards about an axis (with the axis being located in an area where the connecting rod is attached to the water tap release). The upwards rotation of the water tap release, in turn, causes water to be dispensed from a spout.

According to such aspects of the invention, the connecting rod is preferably comprised of a flexible material, and includes two protruding dowel portions located at the second end thereof. The invention provides that the dowel portions are, preferably, configured to be received by corresponding apertures located in the water tap release—and to serve as the axis about which the water tap release will rotate when the second actuating mechanism is activated. According to such embodiments, the connecting rod may be contorted, causing the dowels to be "pinched" into the apertures of the water tap release, such that the use of screws or other hardware to rotatably attach these components together can be avoided.

The above-mentioned and additional features of the present invention are further illustrated in the Detailed Description contained herein.

DETAILED DESCRIPTION OF THE INVENTION

The following will describe in detail several preferred embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used and made without departing from the scope and spirit of the invention.

Figure 6:
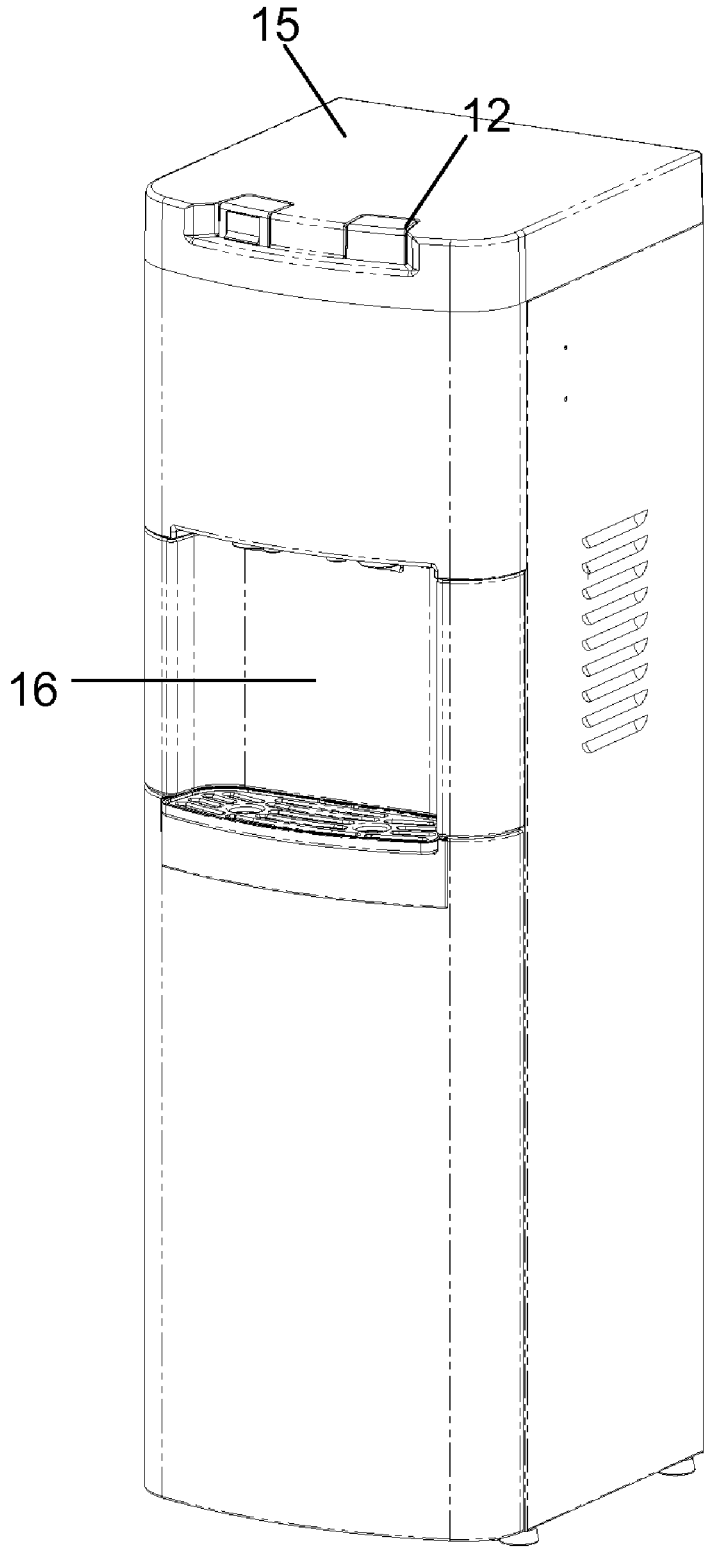
FIG. 6: A perspective-view of the water dispenser described herein.
Figure 7:
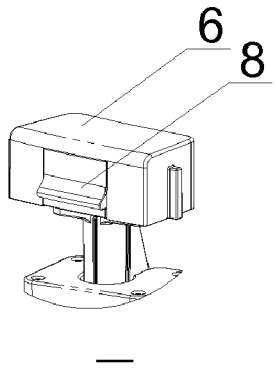
FIG. 7: A perspective-view of the cap and button portions of the faucet actuators described herein.

Referring to FIGS. 1-10, according to certain preferred embodiments of the present invention, bottled water dispensers are provided. The bottled water dispensers include a cabinet having an exterior portion, which includes side walls, a top wall, and a bottom wall (FIG. 6). The water dispensers include at least one water dispensing actuator, which includes a cap portion 6 having an exterior top surface 12 that is flush with the top wall 15 of the bottled water dispenser. The cap portion 6 also includes a button 8 that is substantially parallel with a side wall of the dispenser. The exterior top surface 12 of the cap portion must be pressed downwards, and the button 8 must be pushed inwards, in order to release water from the dispenser. The dispenser preferably comprises a stop 7 (FIGS. 1 and 5), located within a recessed area 16 of a side wall. The recessed area 16 is adapted to receive a container (FIG. 2) into which water may be dispensed. The stop 7 is preferably positioned near the top side of the recessed area 16, such that the stop 7 will make contact with the container when it has been inserted into the recessed area 16 a sufficient distance to receive dispensed water.

Figure 8:
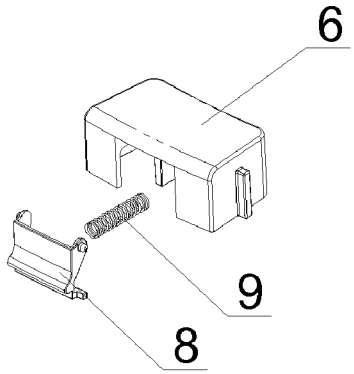
FIG. 8: A disassembled perspective-view of the cap and button portions of the faucet actuators described herein.

According to further preferred embodiments of the invention, actuating mechanisms are provided, which, upon being activated, cause water to be dispensed from the water dispensers described herein. More particularly, a first actuating mechanism is associated with the button 8 of the cap portion 6 mentioned above. Referring to FIG. 8, the button 8 is connected to a spring 9, which exerts a constant outward force on the button 8, such that the first actuating mechanism remains inactive during a resting state (i.e., without the application of an inward force to the button 8). The button 8 may be pressed inward, thereby causing the spring 9 to be compressed, to activate the first actuating mechanism. The inward movement of the button 8, and the compression of the spring 9, will mechanically unlock the cap portion 6, such that the exterior top surface 12 of the cap portion 6 may then be pressed downwards. As such, the invention provides that a second actuating mechanism (discussed below), a portion of which is also coupled with the cap portion 6, may not be activated unless the first actuating mechanism is activated (i.e., unless the button 8 is pressed inward by a user). This provides a "child safety" feature for the water dispensers described herein, insofar as the first actuating mechanism must be activated (i.e., the button 8 must be pressed inward by a user), and the second actuating mechanism must be simultaneously activated, as described below), in order to dispense water. Furthermore, because the cap portion 6 is flush with the top wall of the dispenser, the cap portion 6 (and, therefore, both actuating mechanisms) will be difficult, if not impossible, for a child to reach. As such, not only would it be difficult for a child to reach the cap portion 6, this design requires two independent actions to dispense water (i.e., the first and second actuating mechanisms must be simultaneously activated), which will be effective to prevent a child from dispensing water therefrom without parent supervision.

The second actuating mechanism is activated by pressing the exterior top surface 12 of the cap portion 6 downwards toward the interior portion of the water dispenser. The second actuating mechanism comprises an "h"-shaped push rod 3, which includes (i) a first portion 17 (FIG. 3) that is operably coupled to the cap portion 6, (ii) a second portion 18 that is received by a channel 5 when the exterior top surface 12 of the cap portion 6 is pressed downwards, and (iii) a third portion 19 that is operably coupled to a first end 20 (FIG. 1) of a connecting rod 2. The channel 5 will, preferably, comprise a spring 4 which exerts a constant upwards force on the first 17 and second 18 portions of the push rod 3, such that the second actuating mechanism remains inactive during a resting state (i.e., without the application of a downward force to the exterior top surface 12 of the cap portion 6). As used herein, the phrase "operably coupled," and similar phrases, refers to a first element being connected, directly or indirectly, with a second element, such that movement of the first element will cause a corresponding movement to the second element.

Figure 1:
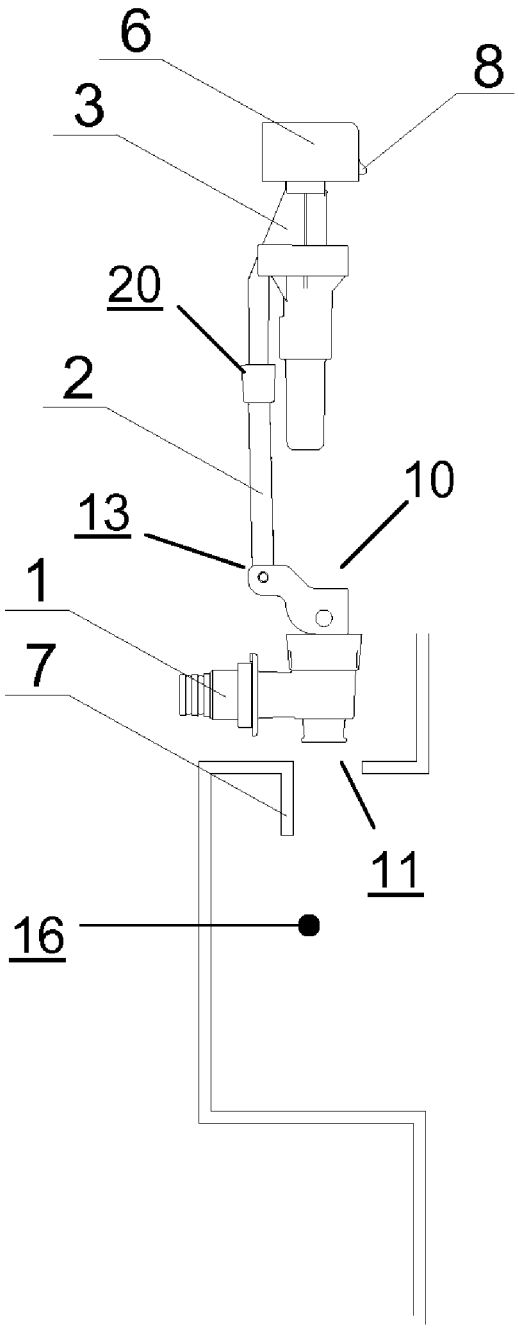
FIG. 1: A side-view of the faucet actuator described herein, in a closed position.
Figure 2:
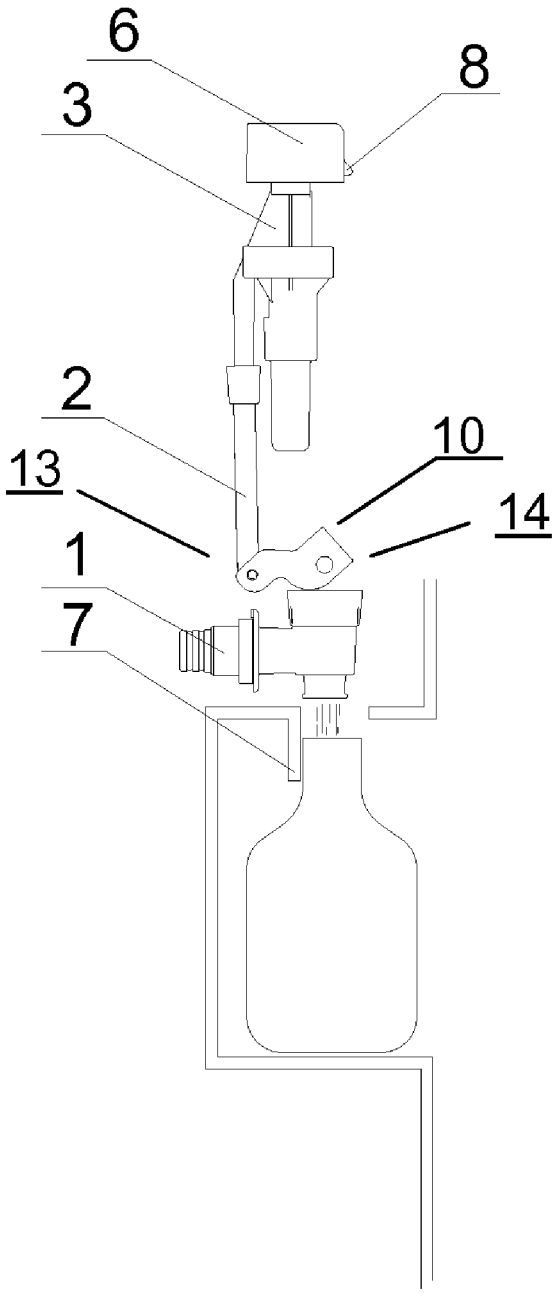
FIG. 2: A side-view of the faucet actuator described herein, in an open position, showing water being dispensed from the valve (spout) into a container.
Figure 3:
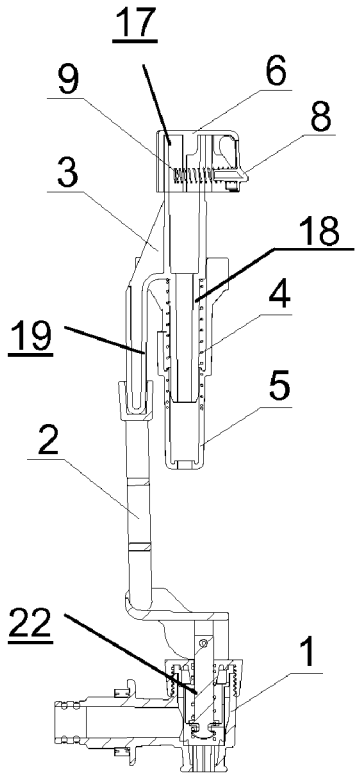
FIG. 3: A cross-sectional, side-view of the faucet actuator described herein.
Figure 4:
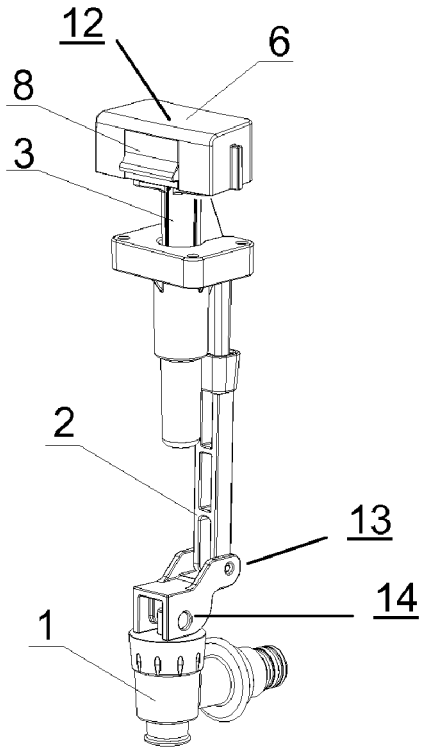
FIG. 4: A perspective-view of the faucet actuator described herein.
Figure 5:
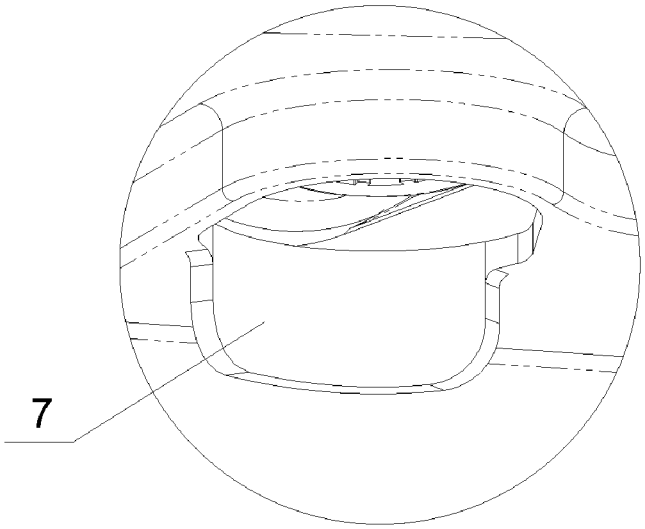
FIG. 5: A magnified view of the water container stop described herein.

A second end of the connecting rod is rotatably attached to a water tap release 10, such that upon pressing the exterior top surface 12 of the cap portion 6 downwards toward the interior of the water dispenser, a series of events occur to release water from the dispenser. Specifically, upon pressing the exterior top surface 12 of the cap portion 6 downwards, the first portion 17 of the push rod 3 is forced downward, causing the second portion 18 to be inserted into the channel 5 and the third portion 19 to cause the connecting rod 2 to also be forced downward. The downward movement of the connecting rod 2 causes the water tap release 10 to rotate upwards about an axis 13 (with the axis 13 being located in an area where the second end of the connecting rod 2 is attached to the water tap release 10). The upwards rotation of the water tap release 10, in turn, causes water to be dispensed from a spout 11 (which is fluidly connected to a water input valve assembly 1) as shown in FIG. 2. The water tap release 10 may be connected to, for example, a shield 22 (FIG. 3) that will be lifted from an area within the valve 1, when the water tap release 10 rotates upwards, which allows water to flow through the spout and out of the dispenser. The shield 22 will be rotatably connected to the water tap release 10 about an axis 14, such that when the water tap release 10 rotates upwards, the shield 22 is lifted from a channel within the valve assembly 1—thereby allowing water to pass through.

Figure 9:
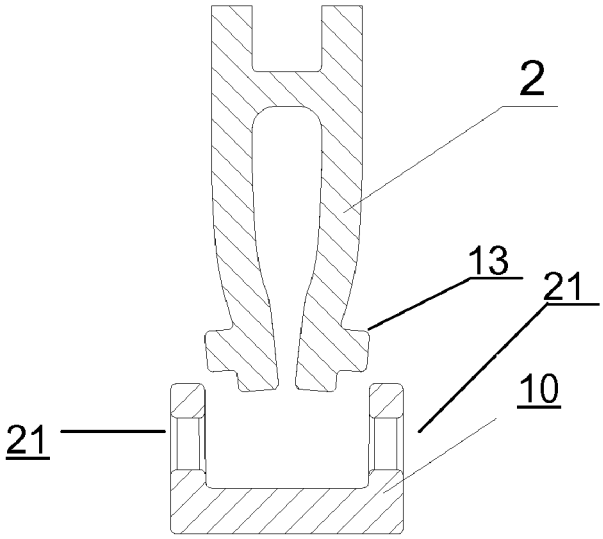
FIG. 9: A diagram illustrating the flexible connecting rod described herein being contorted, such that the dowel portions thereof may be received by corresponding holes in the tap valve assembly (water tap release) described herein.
Figure 10:
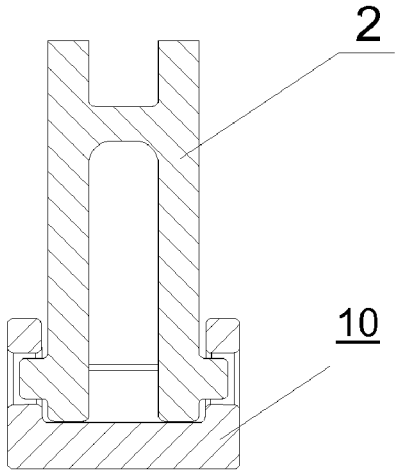
FIG. 10: A diagram illustrating the flexible connecting rod of FIG. 9 being fixed, vis-à-vis the dowel portions thereof, to corresponding holes in the tap valve assembly (water tap release).

According to such aspects of the invention, the connecting rod 2 is preferably comprised of a flexible material, and includes two protruding dowel portions 13 (FIG. 9) located at and protruding from both sides of the second end of the connecting rod 2. The invention provides that the dowel portions 13 are, preferably, configured to be received by corresponding apertures 21 located in the water tap release 10 (FIG. 9)—and to serve as the axis 13 about which the water tap release 10 will rotate when the second actuating mechanism is activated. According to such embodiments, the connecting rod 2 may be contorted, causing the dowel portions 13 to be "pinched" into the apertures 21 of the water tap release 10, such that the use of screws or other hardware to rotatably attach these components together can be avoided. The attachment of the second end of the connecting rod 2 to the water tap release 10 is illustrated in FIGS. 9 and 10.

The invention further provides that, in certain preferred embodiments, the spout 11 is located above the recessed area 16 (FIG. 1) and, therefore, will not be visible from outside of the water dispenser (FIG. 6). Such design will prevent the spout 11, and other elements connected thereto, from being contacted with human hands (and, furthermore, will limit the amount of air exposure). This design will serve to mitigate the risk of unwanted contamination. In addition, such design is more aesthetically pleasing.

The invention provides that the water dispensers may include reservoirs, and other assemblies, for holding and dispensing hot and cold water. For example, the water dispensers may include an internal cold tank which holds a volume of water, which preferably comprise a means for cooling or chilling the water contained therein, such as by incorporating the use of heat sinks (evaporators) or circulating coolants (refrigerant gasses) along the surfaces thereof. A non-limiting example of such a refrigerant gas includes 134*a* (tetrafluoroethane). Similarly, the water dispensers may include an internal hot tank, which preferably includes a means for heating the water contained therein, such as by including electric heating coils along or near the surface thereof. The cold and hot tanks may be connected to the water input valve 1 of the water dispensing actuator described herein, by way of one or more tubes (which carry water from the tanks to the water input valve 1). Still further, the invention provides that the bottled water dispensers of the present invention may comprise one or more water dispensing actuators, such as two actuators (FIG. 6), with a first actuator being configured to dispense cold water and a second actuator being configured to dispense hot water.

The invention provides that the water dispensers disclosed herein may be constructed of any suitable material, such as plastic, stainless steel, glass, or combinations of the foregoing. Furthermore, although the Figures in the present application show the featured water dispenser as having a four side wall configuration, it should be appreciated that the dispenser may be designed to include three side walls, five side walls, or other suitable configurations.

The many aspects and benefits of the invention are apparent from the detailed description, and thus, it is intended for the following claims to cover all such aspects and benefits of the invention which fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. A bottled water dispenser, which comprises:

(A) a cabinet having an exterior portion, which comprises side walls, a top wall, and a bottom wall;

(B) at least one water dispensing actuator, which comprises a cap portion, wherein an exterior top surface of the cap portion is flush with the top wall of the bottled water dispenser;

(C) a recessed area within one side wall, which is (1) adapted to receive a container into which water may be dispensed and (2) comprises a stop, wherein the stop is configured to make contact with the container when the container has been inserted into the recessed area a sufficient distance to receive dispensed water;

(D) two actuating mechanisms which must both be activated to dispense water, wherein:

(1) a first actuating mechanism comprising a button located on the cap portion, wherein the button is approximately parallel with a side wall and is activated by pressing the button inwards toward an interior portion of the water dispenser; and (2) a second actuating mechanism is activated by pressing the exterior top surface of the cap portion downwards toward the interior portion of the water dispenser, wherein the second actuating mechanism (i) may not be activated unless the first actuating mechanism is activated; and (ii) comprises a push rod, wherein the push rod comprises a first portion that is operably coupled to the cap portion, a second portion that is received by a channel when the exterior top surface of the cap portion is pressed downwards, and a third portion that is operably coupled to a first end of a connecting rod, wherein:

(a) a second end of the connecting rod is rotatably attached to a water tap release, wherein upon pressing the exterior top surface of the cap portion downwards toward the interior of the water dispenser: (i) the first portion of the push rod is forced downward, causing the second portion to be inserted into the channel and the third portion to cause the connecting rod to be forced downward; (ii) a downward movement of the connecting rod causes the water tap release to rotate upwards about an axis, wherein the axis is located in an area where the connecting rod is attached to the water tap release; and (iii) the upwards rotation of the water tap release causes water to be dispensed from a spout; and (b) the connecting rod is comprised of a flexible material and two dowel portions located at the second end thereof and is rotatably attached to the water tap release without screws, wherein the dowel portions are configured (i) to be received by corresponding apertures located in the water tap release and (ii) to serve as the axis about which the water tap release will rotate when the second actuating mechanism is activated.

2. The bottled water dispenser of claim 1, wherein the spout is located above the recessed area and not visible from outside of the water dispenser.

3. The bottled water dispenser of claim 1, wherein the channel comprises a spring which exerts a constant upwards force on the first and second portion of the push rod.

4. The bottled water dispenser of claim 1, wherein the dispenser comprises two water dispensing actuators, wherein a first actuator is configured to dispense cold water and a second actuator is configured to dispense hot water.

* * * * *